United States Patent [19]

Levin et al.

[11] Patent Number: 4,723,198

[45] Date of Patent: Feb. 2, 1988

[54] MOTOR VEHICLE HEADLIGHT

[75] Inventors: Robert E. Levin, So. Hamilton; George J. English, Reading, both of Mass.

[73] Assignee: GTE Products Corporation, Danvers, Mass.

[21] Appl. No.: 75,277

[22] Filed: Jul. 20, 1987

Related U.S. Application Data

[63] Continuation of Ser. No. 826,526, Feb. 6, 1986, abandoned.

[51] Int. Cl.[4] ..... F21V 29/00

[52] U.S. Cl. ..... 362/61; 362/268; 362/267; 362/310

[58] Field of Search ..... 362/61, 268, 310, 267, 362/246, 269, 80

[56] References Cited

U.S. PATENT DOCUMENTS

| | | | |
|---|---|---|---|
| 2,748,255 | 5/1956 | Decker | 362/268 |
| 3,392,278 | 7/1968 | Hammerstein | 362/246 |
| 3,408,491 | 10/1968 | George | 362/61 |
| 4,336,578 | 6/1982 | Bradley et al. | 362/310 |
| 4,446,511 | 5/1984 | Sands | 362/267 |
| 4,450,511 | 5/1984 | Micha | 362/267 |
| 4,475,148 | 10/1984 | Tomforde | 362/269 |
| 4,480,296 | 10/1984 | Gagnon et al. | 362/267 |
| 4,545,001 | 10/1985 | English et al. | 362/61 |

*Primary Examiner*—Raymond A. Nelli

*Attorney, Agent, or Firm*—Lawrence R. Fraley

[57] ABSTRACT

A motor vehicle headlight including a parabolic reflector, a cover secured to the reflector and a lighting capsule located within the reflector. The capsule includes an envelope having a coiled filament located therein and including a substantially cylindrical configuration. Optimum light output is attained by providing the reflector with a short focal length (0.2 inch to about 0.5 inch) and by utilization of a coiled filament structure having a length to diameter ratio of less than about 2:1. The result is a headlight having an overall vertical height of only about two inches and a corresponding frontal area of extremely small size (between 3.0 and 7.5 square inches).

14 Claims, 5 Drawing Figures

MOTOR VEHICLE HEADLIGHT

This application is a continuation of application Ser. No. 826,526, filed Feb. 6, 1986, now abandoned.

TECHNICAL FIELD

The present invention relates to headlights for use in motor vehicles (e.g., automobiles).

CROSS REFERENCE TO COPENDING APPLICATIONS

In Ser. No. 598,604, entitled "Sealed Lens Member For Use In A Motor Vehicle Lighting System" (Inventors: G. J. English et al), there is defined a hollow, single piece lens member for use in a motor vehicle lighting system containing a plurality of individual lighting modules. Ser. No. 598,604 is now U.S. Pat. No. 4,545,001.

In Ser. No. 598,614, entitled "Motor Vehicle Lighting System Including A Sealed Lens Member As Part Thereof" (Inventors: R. E. Levin et al), there is defined a motor vehicle lighting system incuding a light source and reflector means, a hollow, enclosed lens having a contoured front surface with a rear lensing surface, and a means for mounting the lens in a recess of said vehicle to assure adequate passage of light from the source through the lens. Ser. No. 598,614 is now U.S. Pat. No. 4,646,207.

In Ser. No. 598,605, entitled "Lamp-Reflector Module For Use In A Motor Vehicle Headlighting System" (Inventors: G. J. English et al), there is claimed the ornamental design for a lamp-reflector module for use in a motor vehicle lighting system. Ser. No. 598,605 is now U.S. Pat. No. Des. 285,351.

In Ser. No. 598,606, entitled "Lens Member For A Motor Vehicle Headlighting System" (Inventors: G. J. English et al), there is claimed the ornamental design for a motor vehicle headlight lens member having a plurality of stepped lensing surfaces thereon and a slightly curved forward surface. Ser. No. 598,606 is now U.S. Pat. Des. 284,112.

In Ser. No. 598,607, entitled "Lens Component For A Motor Vehicle Headlighting System" (Inventors: R. E. Levin et al), there is claimed the ornamental design for a motor vehicle headlight lens having a sloped, clear front surface, a pair of side walls, a bottom wall, and a stepped, rear lensing portion to in turn define a sealed, single piece component. Ser. No. 598,607 is now U.S. Pat. No. Des. 283,362.

In Ser. No. 598,613, entitled "Motor Vehicle Lighting System" (Inventors: G. J. English et al), there is defined a motor vehicle lighting system wherein each of the lighting modules includes a clear cover. The array of modules (e.g., four per side) is designed for use with a spaced, common lens component located a distance from the modules. Ser. No. 598,613 is now U.S. Pat. No. 4,569,002.

In Ser. No. 598,615, entitled "Lighting Module For Motor Vehicle Lighting System" (Inventors: G. J. English et al), there is defined a lighting module for use as part of a vehicle headlighting system wherein the module includes a reflector, a small tungsten halogen capsule sealed within the reflector, and a clear, front cover providing a seal for the module.

All of the above-identified applications were filed Apr. 10, 1984, are assigned to the same assignee as the instant invention, and were subject to an obligation to assign to said assignee or were so assigned at the time the instant invention was made.

BACKGROUND

Previous headlights as typically utilized in automobile headlighting systems have heretofore been relatively large in total frontal area. One factor which contributed significantly to this requirement was the overall vertical height of such headlights. As will be illustrated below, such headlights, whether of round or rectangular configuration, typically required a minimal height of at least four inches. In view of this requirement, the motor vehicle designed to accommodate such headlights in turn was required to possess a relatively large frontal area to serve as a housing for same. As a result, the vehicle exhibited relatively high aerodynamic drag which, as is known, constitutes the principal cause of energy consumption at normal highway speeds. Reducing the drag coefficient in such a motor vehicle in turn results in improved vehicle fuel consumption. The table below represents respective dimensional constraints for many previous headlight systems.

TABLE

| | Headlight Type | Approx. Height (Inches) | Approx. Total System Area (Sq. Inches) |
|---|---|---|---|
| Sealed Beam Headlights | | | |
| 2 Lamp, Round | 2D | 7 | 77 |
| 4 Lamp, Round | 1C/2C | 5¾ | 102 |
| 2 Lamp, Rectangular | 2B | 5¼ | 79 |
| 4 Lamp, Rectangular | 1A/2A | 4¼ | 111 |
| Replaceable Capsule | 2E | 4¼ | 55 |

In the motor vehicle headlighting systems described and illustrated in the aforementioned applications, particularly in Ser. No. 598,613 now U.S. Pat. No. 4,569,002 and Ser. No. 598,615, there is defined a headlighting system which utilizes a plurality of individual lighting modules (headlights) which each possess a relatively short overall height (e.g., two inches). Accordingly, a motor vehicle utilizing such a system can in turn posess a relatively lower front portion to in turn assure improved aerodynamic characteristics.

As will be defined herein, the headlight of the instant invention also possesses a relatively short vertical height and is thus able to assure improved motor vehicle aerodynamics when utilized in such a vehicle. As will be defined, the headlight of the instant invention is able to provide enhanced forward output using a reflector having a relatively small frontal area and an internal light source (coiled filament) having a predetermined length to diameter ratio. The invention is thus adapted for use in a headlighting system possessing additional, similar components, or, alternatively, as part of the headlighting systems defined in the aforementioned copending applications.

It is believed that such a headlight (and a system utilizing same) would constitute a significant advancement in the art.

DISCLOSURE OF THE INVENTION

It is, therefore, a primary object of the instant invention to enhance the motor vehicle headlight art by providing a headlight which possesses a relatively small frontal area and yet which assures enhanced forward illumination for the vehicle utilizing same.

It is another object of the instant invention to provide such a headlight which can be easily utilized with other headlights as part of an overall headlighting system for a motor vehicle wherein the total frontal area required in the vehicle to accommodate such a system is substantially reduced.

It is a still further object of the invention to provide a new headlight which can be produced in an expedient and facile manner.

In accordance with one aspect of the invention, there is provided a motor vehicle headlight comprising a reflector having a concave reflecting portion of substantially parabolic configuration defining a forward opening, the reflector having a relatively short focal length, a cover secured to the reflector for providing a cover for the opening, and a lighting capsule located within the reflector and including an envelope portion having a coiled filament positioned therein and having a substantially cylindrical configuration. The capsule is located within the reflector such that the envelope portion is positioned within and substantially surrounded by the concave reflecting portion and the coiled filament is substantially centered at the focal point of the reflector. The coiled filament possesses a length to diameter ratio of less than about 2:1.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
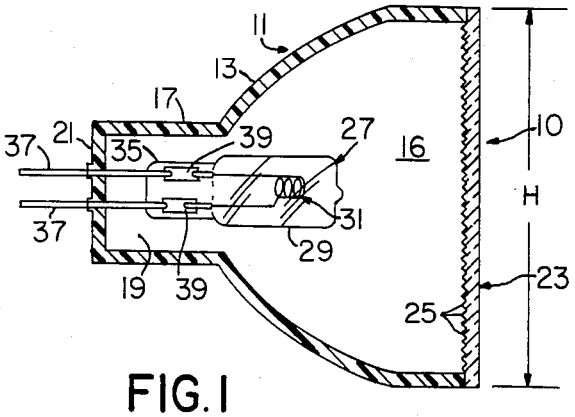
FIG. 1 is a side elevational view, partly in section, of a motor vehicle headlight in accordance with a preferred embodiment of the invention.
Figure 3:
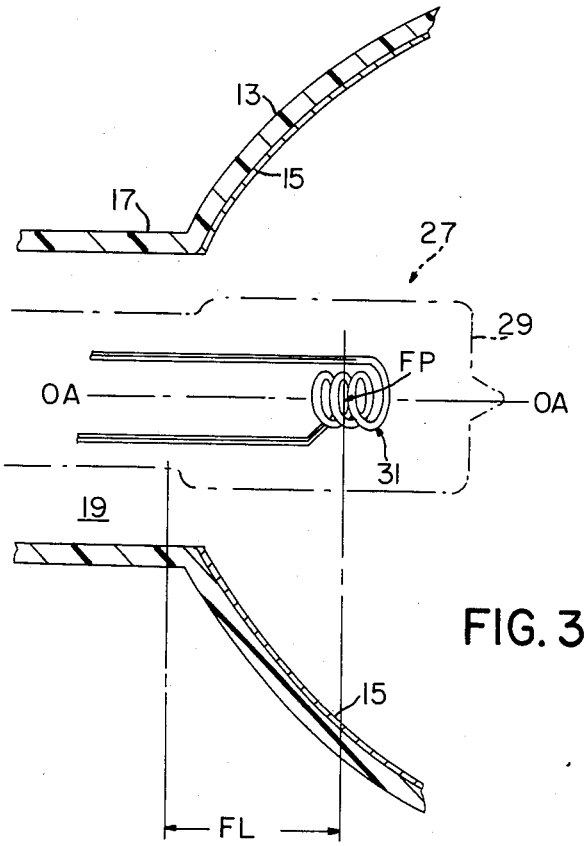
FIG. 3 is an enlarged, partial view of the reflector and lighting capsule components of the headlight of FIG. 1, illustrating the focal length and focal point of the reflector and the relative position of the coiled filament thereto.

With attention to the drawings, and particularly FIG. 1, there is shown a motor vehicle headlight 10 in accordance with a preferred embodiment of the invention. Headlight 10 includes a reflector 11 having a concave reflecting portion 13 of substantially parabolic configuration. Portion 13 is internally coated with a reflective coating material 15 (e.g., aluminum). Coating 15 is shown in FIG. 3. Concave reflecting portion 13 defines a forward opening 16, which, similar to the modules described in the aforementioned applications Ser. No. 598,613 (now U.S. Pat. No. 4,569,002) and Ser. No. 598,615, is of rectangular configuration. Another example of a motor vehicle headlight having an opening of substantially rectangular configuration is shown and described in U.S. Pat. No. 4,545,001, the disclosure of which is incorporated herein by reference.

Reflector 11 further includes a projecting neck portion 17 which extends from the rear, apex part of the reflector and which includes a relatively large aperture (recessed portion) 19 therein. Closure for neck portion 17 is provided by a rear wall 21 which may be secured to or which may form part of neck 17. Reflector 11 is a glass-filled thermoplastic, preferably one sold under the product name "Ryton" by Philips Petroleum, Inc., Bartlesville, Okla. An alternative plastic suitable for the reflector is a mineral-filled nylon.

Secured to the front of reflector 11 and providing a cover for the forward opening thereof is a cover member 23. Cover 23, as illustrated, is of planar configuration, similar to the forward opening 16 defined by reflector 11. In a preferred embodiment cover 23 serves as a lens member and thus includes a plurality of lensing elements 25 located on an internal surface thereof facing the invention's lighting capsule 27. These lensing elements are arranged in a predetermined pattern to provide either the high or low beam functions for headlight 10. Cover 23 is preferably of glass material but alternatively may be of plastic (e.g., a polycarbonate). If glass, cover 23 is secured to reflector 11 using a suitable adhesive known in the art. If of plastic, cover 23 may be similarly attached or secured to the reflector using an alternative means such as ultrasonic welding. As yet another alternative embodiment, cover 23 may be clear (transparent and devoid of lensing elements) should headlight 10 be utilized with a separate lensing member located immediately in front of cover 23. One example of such a lensing member is described and illustrated in the aforementioned U.S. Pat. No. 4,545,001. Preferably, however, cover 23 serves as a lens number in the manner depicted in FIG. 1.

As stated, headlight 10 further includes a lighting capsule 27 which serves as the invention's light source. As shown in FIG. 1, capsule 27 is located within reflector 11 and includes an envelope portion 29 having therein a coiled filament 31. Understandably, filament 31 provides the light source for headlight 10 upon electrical energization thereof. Capsule 27 is preferably a tungsten halogen capsule wherein filament 31 is of tungsten material and the sealed envelope 29 includes a halogen gas therein. The halogen cycle is known in the lighting field and further explanation is thus not deemed necessary. One example of a tungsten halogen lamp is described in U.S. Pat. No. 4,262,229, the disclosure of which is incorporated herein by reference. As further shown in FIG. 1, capsule 27 also includes a press sealed end portion 35 located adjacent the hollow envelope 29 and in which is positioned a pair of lead-in conductors 37 which are electrically coupled to filament 31. The preferred material for capsule 27 is glass (e.g., quartz) while that for the lead-in conductors is preferably nickel or molybdenum. Conductors 37 are sealed within end 35 during formation thereof and may include an interconnecting molybdenum foil 39 as part thereof. Use of such a foil in tungsten halogen lamps as known. Understandably, each lead-in conductor provides a path for electrical current when coupled to an appropriate external connector or the like which forms part of the motor vehicle's electrical system. Each of the externally projecting ends of conductors 37 is rigid in construction and is firmly positioned and passes through the electrically insulative back wall 21 of reflector 11. This securement may be accomplished by ultrasonic welding or, alternatively, using a suitable adhesive. In either event, this form of retention serves to positively orient capsule 27 in the position depicted without the need for additional clamping members or the like about press sealed end 35.

Figure 2:
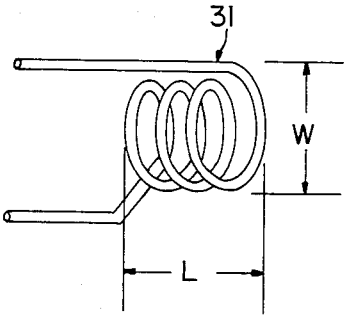
FIG. 2 is an enlarged, partial view of one example of a coiled filament structure for use in the headlight depicted in FIG. 1.

In accordance with the teachings herein, capsule 27 is positioned within reflector 11 such that envelope portion 29 is located within and substantially surrounded by the parabolic, concave reflecting portion 13. In addition, coiled filament 31 is substantially centered at the focal point FP (FIG. 3) of the reflector. Further in accordance with the teachings of the instant invention, coiled filament 31 is of substantially cylindrical configuration (FIG. 2) and possesses a length to diameter (width) ratio of less than 2:1. The length dimension is represented by the letter L in FIG. 2 while the diameter (or width) dimension is depicted by the letter W in FIG. 2.

Further, the length L of the coil must be small in comparison to the focal length FL of the nominally parabolic reflector. This requirement is necessary to assure that the bundle of rays reflected at each point on the reflective surface will have sufficiently small divergence such that said reflected light is efficiently utilized in the usual automotive headlamp light is distribution pattern; that is, a distribution with greater angular divergence horizontally than vertically. For the small aperture, short focal length reflector described herein, the filament possesses a length that does not exceed approximately 30 percent of the reflector focal length.

Utilization of a filament structure possessing the above dimensional requirements in combination with a parabolic reflector having a relatively short focal length (FL in FIG. 3) has resulted in a headlight possessing enhanced forward light output. Specifically, use of such a reflector enables greater flux collection efficiency for the light emitted from filament 31. In addition, utilization of a filament having the described length to diameter ratio insures that elemental beam spread leaving such a reflector is never much greater in the vertical direction than in the horizontal direction. Excessive vertical spread represents wasted light from such a headlight because the required vertical spread is significantly less than the corresponding horizontal requirement. In other terms, the forward projected light from each elemental beam contributes greater to the desired forward, substantially horizontal pattern if its spread in both the vertical and horizontal directions is substantially the same. Excessive vertical spread by such a beam also increases the amount of glare from a headlight.

Coiled filament 31, which may also be of coiled-coil configuration (FIG. 5), is preferably located axially along the reflector's optical axis OA—OA (FIG. 3). Alternatively, filament 31 may lie orthogonal to the optical axis provided it is of course centered at focal point FP.

As stated, the reflector of the invention possesses a relatively short focal length. As further stated, this results in a reflector possessing increasing optical efficiency. In most prior rectangular shaped headlamps wherein the forward opening is rectangular as is that of the instant invention, such as illustrated in U.S. Pat. No. 4,210,841, the parabolic upper and lower reflecting surfaces are restricted by substantially horizontal planes to thus deprive the reflector of much of its parabolic reflecting regions. As a result, flux incident on these horizontal planes is lost from the principal beam of the headlight. Utilization of a shorter focal length and minimal horizontal surfaces reduces the solid angle of flux interception by these planar areas for a given forward open area of rectangular configuration. As shown in FIG. 1, reflector 11 utilizes minimal cut-off to the parabolic reflecting surfaces thereof while still maintaining the aforementioned extremely small vertical height (about two inches or less). In accordance with the teachings of the instant invention, reflector 11 possessed a focal length within the range of from about 0.2 inch to about 0.5 inch. Such a length is clearly extremely small, particularly when considering that required in the headlights utilized in the systems listed in the aforementioned TABLE. Typically, such headlights require a focal length in the range of from 1.0 to 1.5 inches.

As stated, the overall vertical height (H in FIG. 1) for headlight 10 is very small. In accordance of the teachings herein, the preferred vertical height H for headlight 10 is within the range of from about only 1.5 to about 2.5 inches. The corresponding width dimension (in a direction toward and away from the viewer in FIG. 1) for the reflector's rectangular opening is preferably within the range of from about only 2.0 to about 3.0 inches. Accordingly, headlight 10 possesses a forward rectangular opening within the range of from only about 3.0 square inches to about 7.5 square inches. As a result, the ratio of such a rectangular open area to the relatively short focal length of reflector 11 is within the range of from about 6:1 to about 37.5:1.

EXAMPLE

In one example of the invention, a headlight was made wherein the plastic reflector possessed a rectangular opening having a height of about 2.0 inches and a correspondence width of 2.5 inches. The corresponding focal length was only about 0.30 inch and the filament's length to diameter ratio was an ideal 1:1. The coil possessed an outer diameter of about 0.065 inch. The capsule secured within the reflector, having an axially aligned coiled-coil tungsten filament, was operational at a wattage of only about 20 watts. The planar cover which provided the closure for the reflector's rectangular opening was of glass material and included the aforedescribed internal lensing elements.

As illustrated by the above example, the lighting capsule is operational at low wattages. By low wattage is meant a wattage within the range of from about ten to about twenty-five watts. In addition, headlight 10 is preferably utilized in combination with at least three additional similar components to form an overall array of four such components. Two such arrays are utilized per vehicle, with each array being positioned on one side thereof. Even further, each of these headlights is preferably arranged in a horizontal, planar orientation such as depicted in U.S. Pat. No. 4,545,001. This is not meant to limit the invention, however, in that these arrays may be successfully arranged in different orientations to thus accommodate the vehicle's forward shape.

Capsule 27 is oriented within reflector 11 such that the press sealed end 35 is located within (and surrounded by) the extending neck portion 17. This arrangement serves to substantially prevent light scatter from headlight 10 which in turn can contribute to the aforementioned glare problem. The press sealed end 35 of a capsule such as depicted herein will adversely effect the capsule's light output. Accordingly, positioning of this part of the capsule within a recessed area of the reflector serves to prevent such scattering, particularly if the internal surfaces of the neck portion 17 do not include a reflective coating thereon. It is seen in FIG. 3 that the described reflective coating 15 does not extend into this recessed area of the reflector. The above positioning relationship thus serves to further assure optimum light output for the instant invention.

Figure 4:
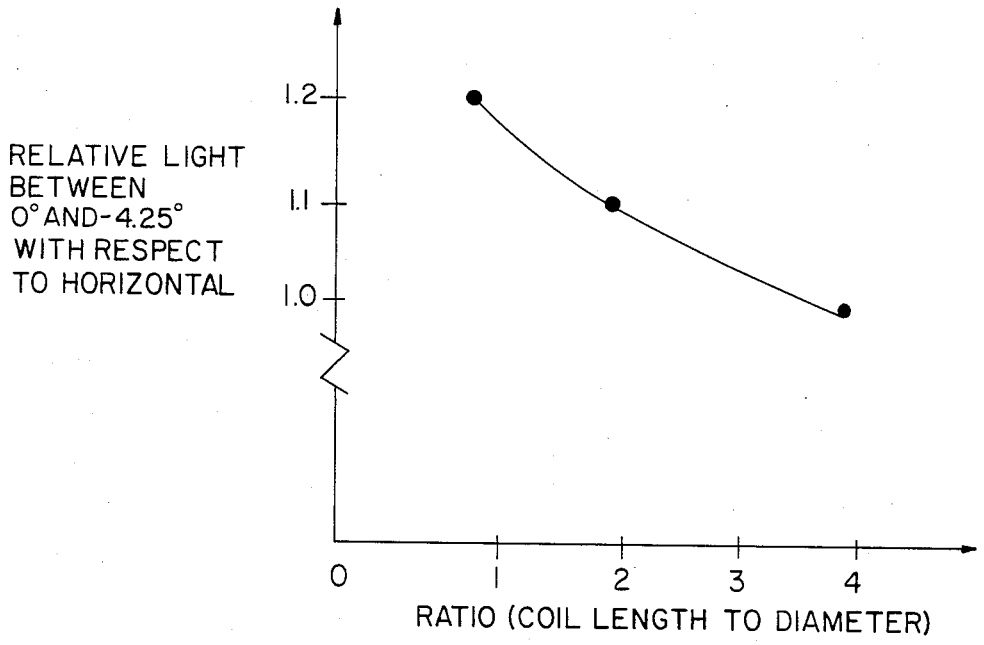
FIG. 4 represents a chart illustrating the relative light output (between 0° and −4.25° with respect to horizontal) in comparison to the ratio of coil length to diameter for a coiled filament as used in the instant invention.

With particular attention to FIG. 4, there is provided a chart which illustrates the relationship between relative light output in comparison to the ratio of filament length to diameter for the low wattage coils. Specifically, it is seen that a relatively high ratio of about 4:1 provides about twenty percent less relative light in comparison to an ideal ratio of 1:1 as taught herein. This light output is measured within a field of from 0° to a negative 4.25° with respect to horizontal. The 0° coordinate of the field in that horizontal line which intersects the optical axis of the headlight when the headlight is faced in that direction. Accordingly, the negative 4.25° coordinate is that horizontal line at approximately 4.25° below the horizontal 0° line. This field understandably is located at a distance forward of the headlight.

Figure 5:
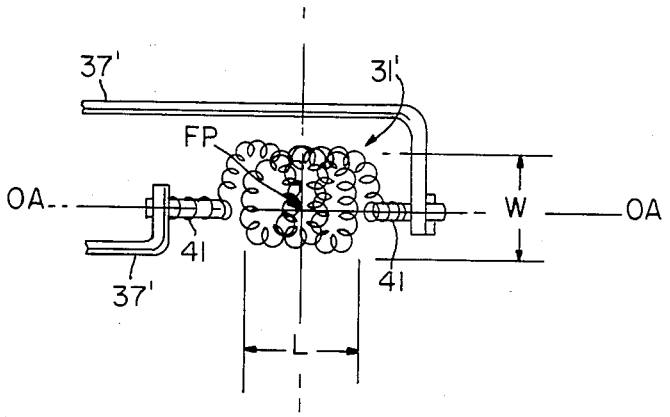
FIG. 5 represents a preferred embodiment of a coiled-coil filament structure for use in the invention.

In FIG. 5, there is shown a filament structure 31' in accordance with a preferred embodiment of the invention. Filament 31' is of coiled-coil construction and produced from tungsten wire. Formation is achieved by winding this wire about a suitable mandrel (e.g., molybdenum rod) to form a single coiled member. This structure is then formed (coiled) to provide the shape depicted in FIG. 5. A suitable high temperature wax is then applied to the end segments of the structure and the structure is then acid etched to remove the mandrel, excluding of course the protected end segments. Accordingly, the mandrel rod sections 41 remain in place and are surrounded by the respective internal ends of lead-in conductors 37'. The resulting coiled-coil filamentary material is axially oriented along the optical axis OA—OA as shown, as well as being centered at focal point FP. Uniquely, the mandrel-containing ends are not activated (do not glow) upon filament energization due to the thermal "quenching" by the mandrel material. Only the non-protected portions (defined substantially by the L and W dimensional arrows) will glow during energization. This unique arrangement enables formation of a filament structure of coiled-coil configuration wherein the ideal 1:1 ratio of length to diameter is possible, thus assuring a substantial point source of light for reflector 11.

Utilization of a plurality (e.g., four) of headlights of the type defined herein within each of two spaced arrays for a motor vehicle provides several advantages over many known prior art systems. First, the use of multiple sources of the number mentioned provides desired redundancy in that more than one section of the overall system provides illumination to the same region of space (forward pattern). Thus, should one headlight fail (e.g., burn out), a major portion of the forward light pattern will not be totally lost as is the situation with many existing headlight systems (typically including a total of only two or four headlights). In the instant invention, about seventy-five percent of the total coverage for any given forward component remains upon the failure of a single headlight in the system. Second, it is acknowledged that only certain parts of the headlight reflector provide beam elements suitable for developing the high intensity gradients required for the sharp cutoff of the low beam pattern near the horizontal plane through the vehicle's light source. A greater percentage of the net reflector area for developing high intensities near the horizontal with minimal glare in the upper left quadrant (toward oncoming drivers) is possible utilizing a headlight as defined herein in view of the utilization of several individual reflector elements. Thirdly, an increase in the number of individual headlight units in turn increases the flexibility of optimizing both high and low beams. This is possible by switching (activating) selected headlight units for either high or low beam or leaving other units energized for both patterns. Present headlight systems in which two filaments are activated in a single lens-reflector headlight unit do not typically possess such flexibility. With these existing systems, the lens elements can be optimized for only one pattern and switching to a second filament produces at best a compromised light distribution.

Fourthly, the small vertical dimension and the freedom to configure various arrangements of a plurality of small headlamps as taught herein enhances the ability to form aerodynamic front ends for vehicles utilizing the invention.

There has thus been shown and described a motor vehicle headlight wherein the reflector possesses a relatively short focal length and the coiled filament utilized in the headlight's lighting source (capsule) possesses already a predetermined length to diameter ratio (less than about 2:1) so as to provide optimum light output for the headlight such that a finished product having a small vertical height (e.g., about two inches) can be produced. The above optimum light output is possible through the teachings herein wherein the headlight's reflector possesses a relatively small forward opening in combination with the defined short focal length.

While there have been shown and described what are at present considered the preferred embodiments of the invention, it will be obvious to those skilled in the art that various changes and modifications may be made therein without departing from the scope of the invention as defined by the appended claims.

What is claimed is:

1. A motor vehicle headlight comprising:

a reflector having a concave reflecting portion of substantially parabolic configuration defining a forward opening, said reflector having a focal length within the range of 0.2 inch to 0.5 inch;

a cover secured to said reflector for providing a cover for said opening; and a lighting capsule located within said reflector and including an envelope portion having a coiled filament positioned therein and having a substantially cylindrical configuration, said capsule being located within said reflector such that said envelope portion is positioned within and substantially surrounded by said concave reflecting portion and said coiled filament is substantially centered at the focal point of said reflector, said coiled filament having a length to diameter ratio of less than 2:1.

2. The headlight according to claim 1 wherein said forward opening is substantially planar and of a rectangular configuration, the ratio of the area of said rectangular opening to said focal length of said reflector being within the range of 6.0:1 to 37.5:1.

3. The headlight according to claim 2 wherein said area of said rectangular opening is within the range of 3.0 square inches to 7.5 square inches.

4. The headlight according to claim 1 wherein said length to diameter ratio of said coiled filament is 1:1.

5. The headlight according to claim 1 wherein the length of said filament is no greater than thirty percent of said focal length of said reflector.

6. The headlight according to claim 1 wherein said reflector includes a neck portion projecting from the rear of said reflector and including an aperture therein, said capsule further including a sealed end portion adjacent said envelope portion and positioned within said aperture to substantially prevent light scattering.

7. The headlight according to claim 6 wherein said capsule is a tungsten halogen capsule and said sealed end is a press sealed end.

8. The headlight according to claim 7 wherein said capsule further includes a pair of lead-in conductors electrically coupled to said coiled filament and being positioned substantially within said press sealed end and projecting therefrom.

9. The headlight according to claim 8 wherein said neck portion of said reflector includes a rear wall, each of the projecting portions of said lead-in conductors being positioned within and passing through said rear wall.

10. The headlight according to claim 1 wherein said cover secured to said forward opening of said reflector is a lens cover.

11. The headlight according to claim 10 wherein said lens cover includes a plurality of lensing elements located on an internal surface of said lens cover facing said lighting capsule.

12. The headlight according to claim 10 wherein said reflector is plastic and said lens cover is glass.

13. The headlight according to claim 1 wherein said filament is of coiled-coil construction and includes a pair of end segments each having therein a quantity of material for thermally quenching said end segments to prevent activation thereof during energization of said filament.

14. The headlight according to claim 13 wherein said lighting capsule further includes a pair of lead-in conductors, each of said conductors coupled to a respective one of said end segments of said filament.

* * * * *